United States Patent [19]

Kommrusch

[11] 4,176,322

[45] Nov. 27, 1979

[54] RADIO FREQUENCY LENS

[75] Inventor: Richard S. Kommrusch, Schaumburg, Ill.

[73] Assignee: Motorola, Inc., Schaumburg, Ill.

[21] Appl. No.: 828,566

[22] Filed: Aug. 29, 1977

[51] Int. Cl.[2] ..... H01Q 3/26

[52] U.S. Cl. ..... 325/369; 343/854; 343/754

[58] Field of Search ..... 325/366, 369, 370–373, 325/376, 379, 367, 368, 380, 387, 388; 343/854, 754, 853, 858; 333/10

[56] References Cited

U.S. PATENT DOCUMENTS

| | | | |
|---|---|---|---|
| 3,568,207 | 3/1971 | Boyns | 343/854 |
| 3,587,004 | 6/1971 | Parad | 333/10 |
| 3,852,761 | 12/1974 | Bogner | 343/854 |
| 3,916,417 | 10/1975 | Wong et al. | 343/854 |

*Primary Examiner*—Robert L. Richardson
*Assistant Examiner*—Tommy P. Chin
*Attorney, Agent, or Firm*—James P. Hamley; Rolland R. Hackbart; James W. Gillman

[57] ABSTRACT

The inventive lens focuses a plurality of radio frequency signals received by a multi-element antenna array into a coherent signal.

A circular transmission cavity has probe sites located therein. The probe sites are located on radii of the circular cavity approximately one quarter wavelength of the radio frequency of interest from the cavity's perimeter. A probe pair is positioned at each probe site. The signal from each antenna element is coupled through a three port circulator to a particular probe pair via a 180° coupler. Incoherent images received at the probe pair are dumped in a load resistor, whereas the focused image of the received signal is routed through the circulator and to a receiver.

23 Claims, 10 Drawing Figures

RADIO FREQUENCY LENS

BACKGROUND OF THE INVENTION

The present invention pertains to the radio frequency art and, more particularly, to a means for coherently combining a plurality of radio frequency signals.

Lenses for focusing radio frequency signals are well known, especially in the radio communication art. There, for example, multi-element antennas have been used for the reception of remotely broadcast radio signals. Due to the spatial separation among the antenna elements, a wavefront impinging on the antenna array strikes some antennas sooner than others, thereby producing phase differences. If all antenna element signals are combined without phase correction, the resulting signal would be incoherent, or out of focus.

One approach to providing phase coherency is that of the Rotmen lens. Here, each antenna element is coupled through a predetermined coaxial cable to a focal point. The lengths of the cables compensate for the spatial positioning of the antenna elements such that all signals are coherent at the focal point. Thus, a separate set of coaxial cables are required for each desired focal point, thereby resulting in an expensive and bulky lens assembly. Further, a Rotman lens has established limitations in its overall coverage angle.

A more flexible prior art lens than those of the Rotman type is an R-KR lens. In such a lens, which is illustrated in FIG. 1, and which is more fully described herein below, input and output probes are located in predetermined locations in a cylindrical transmission cavity. The dimensions of the cavity and the positioning of the probe sites are such that signals induced in an antenna element from a given signal front are sent to appropriate probes whereby, due to the varying distance between antenna signal probes and a focal probe the desired phase corrections are made thus resulting in a focused image at the focal probe. A major problem with systems of this type is that due to the radiation pattern of each probe, internal reflections within the cavity may be generated thus resulting in phase incoherencies and an unfocused image. One approach to minimizing reflections has been to fill the cavity with a lossy dielectric material, thereby reducing the amplitude of reflected signals. This approach is undesirable due to an increased system loss of between 3 and 10db. Another attempt to minimize phase incoherencies has been to provide two probes at each probe site, with the two probes being driven in phase. Though this approach was superior to the single probe case, substantial defocusing of the lens still occured.

A further prior art approach is the Luneberg lens. Here, a transmission cavity is comprised of two circular plates which form a transverse electromagnetic wave (TEM) cavity. Probes are placed within the cavity as in the R-KR lens. The region between the plates is partially filled with a tapered dielectric material. While this system is effective in reducing some incoherent signal images, it is costly to build.

SUMMARY OF THE INVENTION

It is an object of this invention, therefore, to provide an improved radio frequency lens which is capable of focusing a plurality of input signals while substantially suppressing incoherent images.

It is a further object of the invention to provide the above described improved radio frequency lens which does not require the use of a lossy dielectric material.

An additional object of the invention is to provide the above described improved radio frequency lens which is simple and inexpensive to construct but precise in operation.

Briefly, according to the invention, the radio frequency lens receives and focuses a plurality of radio frequency signals. The lens comprises a transmission cavity having a plurality of probe sites therein. The cavity is of a predetermined construction to transmit RF signals among the probe sites. Probe pairs are positioned at each probe site. A coupler couples each one of the plurality of signals to one of the probe pairs. The probe coupler coherently combines RF signals received by each probe of a probe pair to provide a first summed output and incoherently combines the RF signals received by each probe of the respective probe pair to provide a second difference output. Included within the probe coupler is a means for phase shifting the signals for providing a first output to which coherent signals received by the probe pair are routed and a second output to which incoherent signals received by the probe pair are routed. Preferably, the coupler is of the 180° type and with a dissipation resistor coupled to its second difference output.

DETAILED DESCRIPTION OF THE PREFERRED EMBODIMENT OF THE INVENTION

Figure 1:
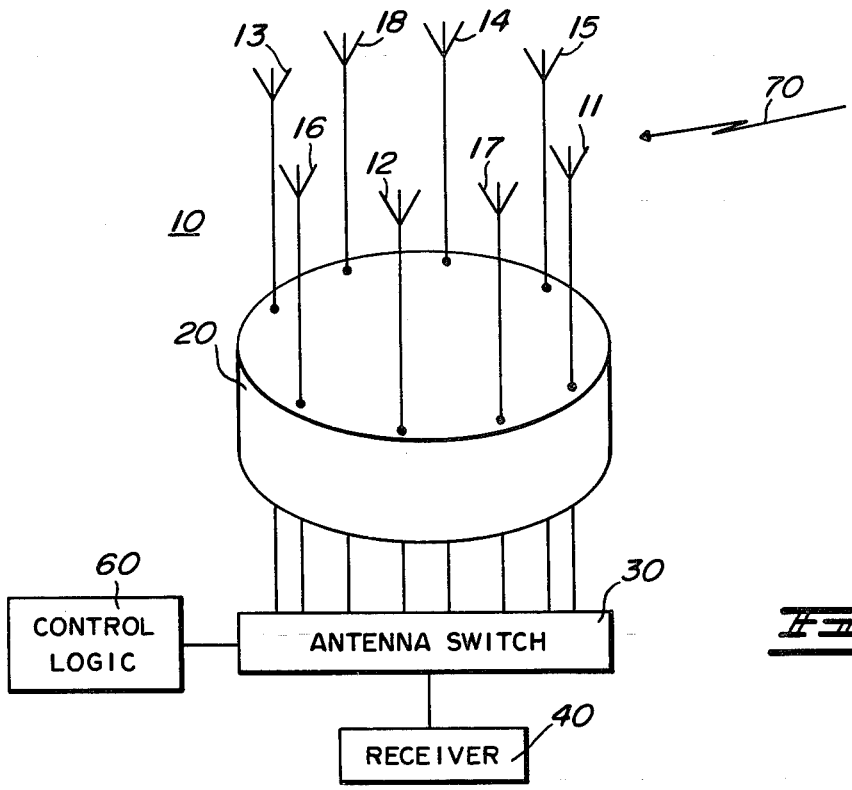
Fig. 1 PRIOR ART
FIG. 1 is a generalized block diagram illustrating application of a radio frequency lens in a multi-element antenna receiving system.

FIG. 1 illustrates a multi-element antenna system. Here a circular antenna rray 10 is comprised of eight antenna elements 11–18, inclusive. Signals induced in the antenna elements 11–18 are coupled through an antenna lens 20 and an antenna switch 30 to a receiver 40. A control logic 60 controls the condition of the antenna switch 30 whereby the radiation pattern of the antenna array 10 may be controlled. While such systems are generally known in the array radio communication art, a particularly effective communication system is that described in copending U.S. patent application Ser. No. 792,961, entitled "Sectored Antenna Receiving System," invented by Timothy P. Craig and James R. Stimple, and filed May 2, 1977, assigned to the same assignee as the instant invention.

For the example wherein the antenna array 10 is switched to receive a wavefront originating from the general direction indicated by the arrow 70, it should be apparent that the signal induced in antenna element 11 phase leads that induced in antenna elements 12, 13, which in turn phase lead that induced in antenna elements 14, 15, and so forth all due to the spatial separation between antenna elements. If the signals received at each antenna element 1-18 were combined without correcting for phase discrepancies, an incoherent signal would be produced.

Thus, it is the function of the radio frequency lens 20 to provide appropriate time delays to the signals from each antenna element such that the combination of signals results in a coherent, or focused signal.

Figure 2:
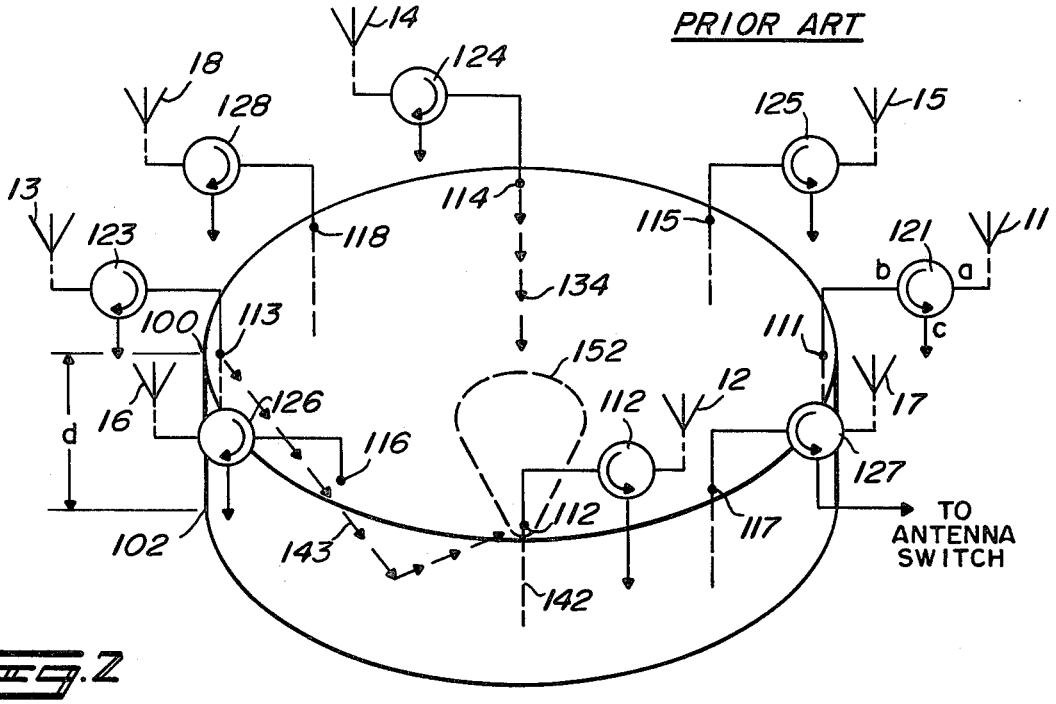
FIG. 2 illustrates a prior art R-KR radio frequency lens.

FIG. 2 illustrates a prior art radio frequency lens assembly, namely, a R-KR lens. Here, a pair of circular plates 100, 102 form a transmission cavity. Thus the distance d between the plates 100, 102 is selected such that the radio frequency signals of interest are transmitted within the cavity.

Provided within the transmission cavity are eight probe sites 111-118. At each probe site 111-118 is positioned a radio frequency probe (one of which is indicated at 142) which extend into the cavity. Each antenna element 11-18 couples to its corresponding probe and probe site 111-118 via coaxial cable and a circulator 121-128. The overall electrical length from each antenna element 11-18 to its corresponding probe site 111-118 is the same.

The circulators 121-128 operate in the conventional mode to couple received signals from an antenna element to a probe site and from the lens to a receiver (not shown). For example, with respect to circulator 121, signals received by the antenna element 11 are coupled from the circulators first terminal a to its second terminal b and thereafter to probe site 111, thereby affecting the received condition. A coherent signal from the lens is coupled back through port b to the circulators third port c whereby it is then coupled to an associated receiver via an antenna switch (such as switch 30 of FIG. 1).

A principal problem with the prior art R-KR lens is the fact that each probe exhibits a single lobe, or cardioid response, as is illustrated by dotted curve 152 for probe 142. Thus, signals, such as the signal 134 from probe site 114 are directly received by probe 142 without internal reflection. However, a wave, such as wave 143 from probe site 113, may strike the boundaries of the circular transmission cavity whereby it is reflected into the probe 142. This results in an incoherent image when the signals received by probe 142 are combined.

Figure 3:
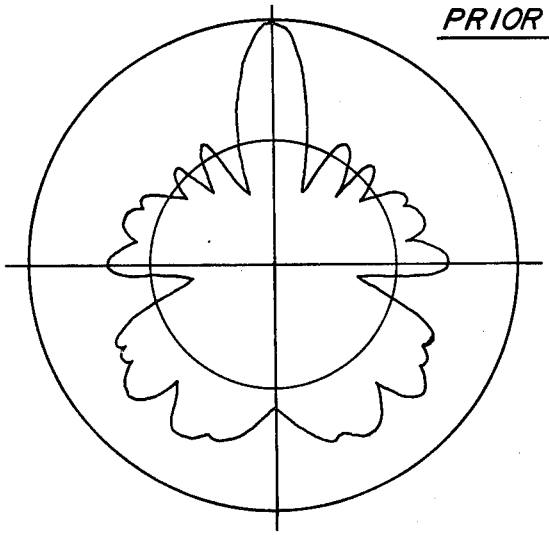
FIG. 3 illustrates the radiation response of the R-KR lens of FIG. 2.

FIG. 3 illustrates a typical radiation pattern for the R-KR lens shown in FIG. 2. Due to the aforementioned reflections created within the lens due to the cardioid radiation patterns from each probe, significant side lobes are observed in the overall radiation pattern.

Figure 4:
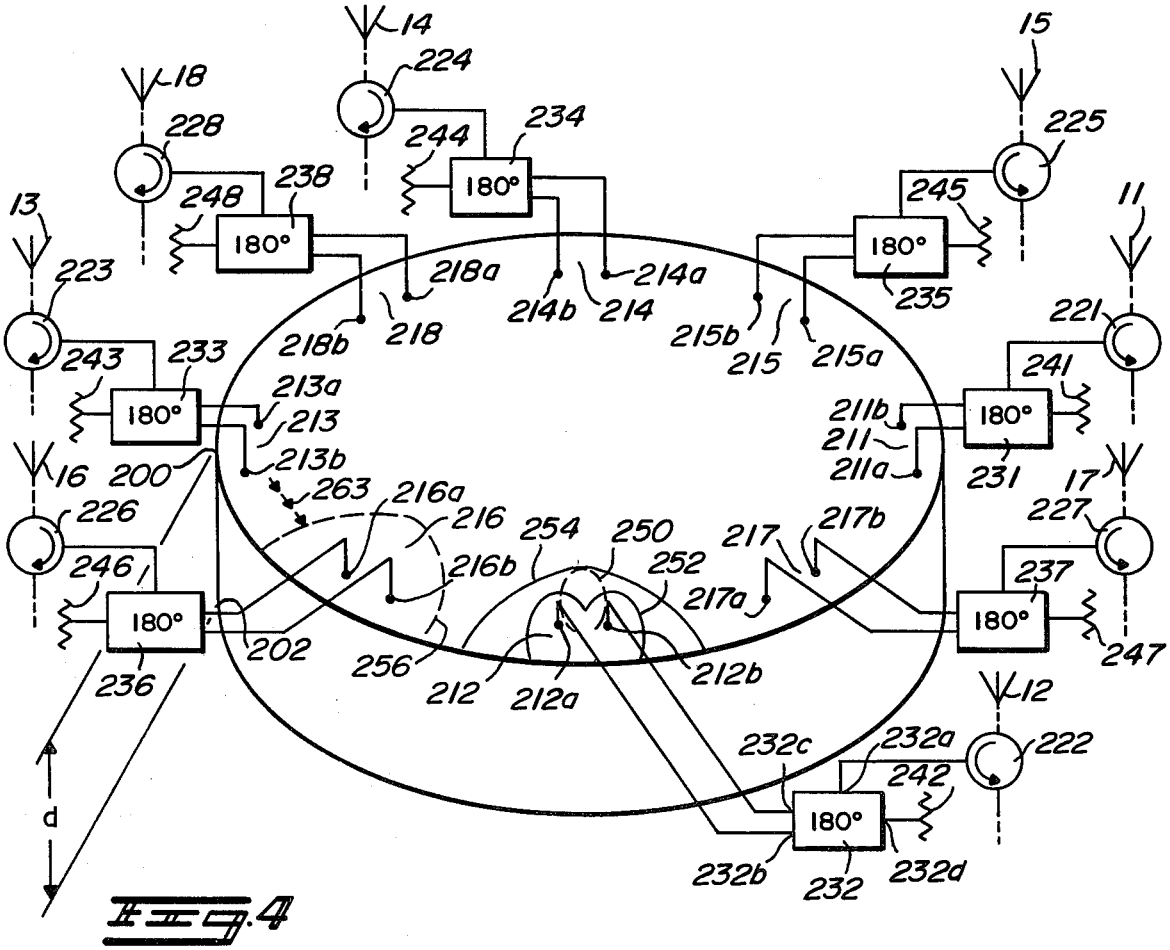
FIG. 4 illustrates the inventive dual probe out-of-phase radio frequency lens.

FIG. 4 illustrates the preferred construction of the inventive radio frequency lens. Here, as with the lens of FIG. 2, a pair of parallel plates 200, 202 are separated by a distance d which, preferably, is less than one half wavelength of the radio frequency signal of interest. Thus, the cavity operates in the transverse electromagnetic wave mode. As before, eight probe sites 211-218 are located within the cavity. These sites are centered on radii of the transmission cavity. Provided within the cavity are eight probe pairs 211*a, b*-218*a, b*. Each probe pair is centered on a radius of the circular transmission cavity, with each probe being spaced approximately one quarter wavelength of the frequency of interest from the perimeter of the cavity.

Signals induced in each antenna element 11-18 are coupled through corresponding circulators 221-228 which route signals received from each antenna element 11-18 to the lens, and from the lens to an antenna switch for coupling to a receiver as is described hereinabove. The signals are then passed through eight 180° couplers 231-238 which, in turn, apply the signals to each corresponding probe pair. The 180° couplers 231-238 operate in the known manner. That is, for example with respect to coupler 232, a signal applied to the couplers first input terminal 232*a* is split into two equal magnitude, in phase portions which are then applied to the two output terminals 232*b*, 232*c*. A final coupler output 232*d* is terminated in an appropriate load resistor 242 which, as is described more fully with respect to FIGS. 6A-6D and 7 is used to dissipate out-of-phase signal components. Such load resistors 241-248 are shown connecting to the remaining couplers 231-238 respectively.

The radiation pattern produced by each probe pair may be understood by way of example of probe pair 212. The contribution to the radiation plot of the in-phase signal components, as routed to output port 232*a* is the previously described single lobe or cardioid pattern shown as dotted line 250. The contribution to the overall radiation response from the out-of-phase signal components, as routed to output port 232*d*, is that shown as line 252. The two response plots add to form the substantially semicircular response plot 254. Thus, due to the radiation pattern of the inventive probe pair, a wave, such as wave 263 emanating from probe pair 213 does not suffer an internal cavity reflection thereafter being received by the probe pair 212, since it is absorbed by pattern 256 of probe pair 216. Hence, by minimizing internal reflections of signals within the cavity, incoherent images are suppressed.

Figure 5:
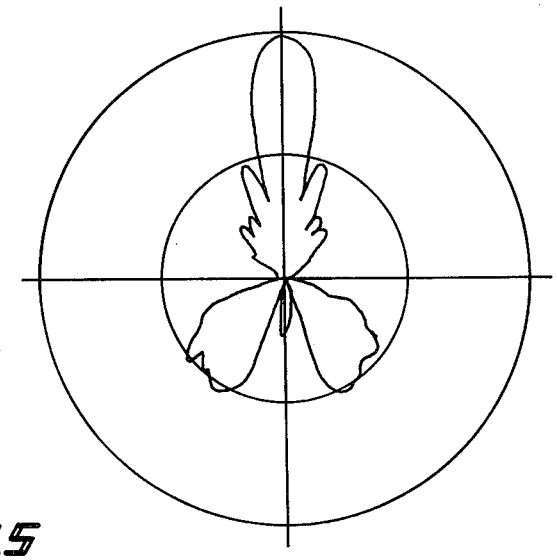
FIG. 5 illustrates the radiation pattern of the inventive lens illustrated in FIG. 4.

FIG. 5 illustrates the overall radiation response plot of the radio frequency lens illustrated in FIG. 4. Here, it should be observed that side lobes due to incoherent imaging are substantially reduced over the prior art R-KR lens shown in FIG. 3. In fact, improved side lobe suppression of from between 11 to 6db has been measured using the inventive dual probe lens assembly.

Figure 6A:
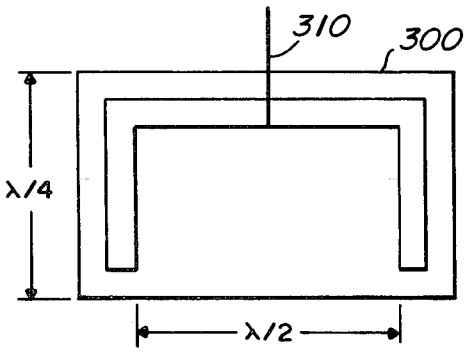
FIGS. 6A through 6D illustrate preferred constructions of the coupler and probe assembly utilizing printed circuit techniques.
Figure 6B:
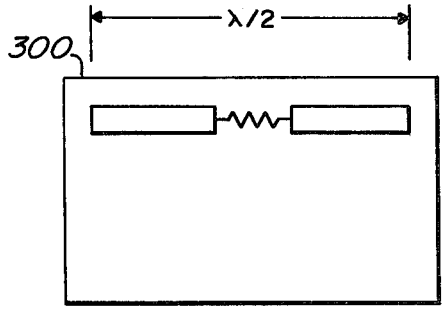

FIGS. 6A and 6B illustrate construction of the dual probe, 180° coupler in printed circuit board form. Here, conductive strips are plated on either side of a dielectric board 300. On one side of the board illustrated in FIG. 6A, a "C" shaped strip is formed, with each arm of the C corresponding to a probe and having a length of approximately one quarter wavelength of the radio frequency of interest, and with the body portion of the C having a length of approximately one half wavelength of the desired radio frequency. The received signal is fed via an input line 310 to the central area of the body portion of the "C" strip.

Formed on the opposite side of the dielectric board 300 as illustrated in FIG. 6B, is a strip having a length which is approximately one half wavelength of the desired radio frequency and which is in register with the body portion of the "C" strip on the opposite side of the board. The metallized strip is broken in its center area, with the two remaining divided portions being bridged by the load resistor.

The resulting printed circuit hybrid 180° coupler may then be inserted at the appropriate probe sites in the circular transmission cavity to thereby provide both the dual probe and the 180° out-of-phase coupling as described above.

Figure 6C:
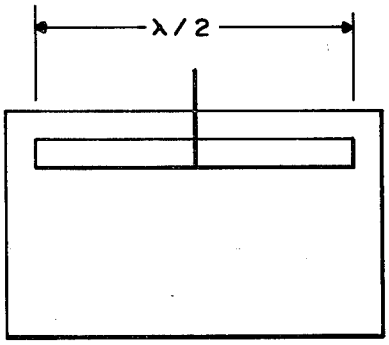
Figure 6D:
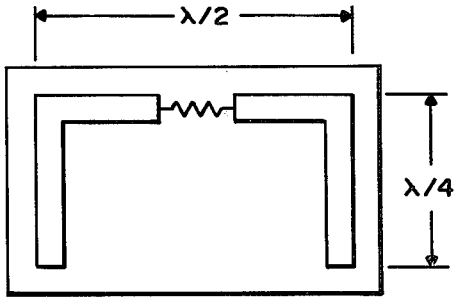

An alternate, complementary embodiment of the probe construction given in FIGS. 6A and 6B is given in FIGS. 6C and 6D, respectively.

Figure 7:
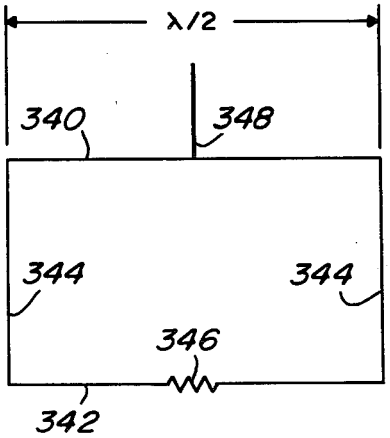
FIG. 7 is an alternate construction of the coupler and dual probe assembly utilizing a wire hoop technique.

An alternate dual probe, 180° coupler is illustrated in FIG. 7. Here, a wire loop is formed in a substantially rectangular configuration. First and second opposing sides 340, 342 of the rectangle have lengths approximately equal to one half wavelength of the desired radio frequency. The third and fourth opposing sides 343, 344 each have a length approximately equal to one quarter wavelength of the desired radio frequency.

The second side 342 is broken at its central portion and a load resistor 346 couples the two divided portions. Signals are coupled to this embodiment of the two probe, out-of-phase coupler at the central portion of the first side 340 via the coupling cable 348.

As with the coupler illustrated in FIGS. 6A and 6B, a wire loop type coupler illustrated in FIG. 7 may be inserted in each probe site of the circular transmission cavity to thereby provide both the dual probe, and the 180° coupling functions.

In summary, an improved radio frequency lens has been described, which lens includes means to effectively suppress incoherent images. The resulting structure does not require the use of lossy dielectrics, it is relatively inexpensive to fabricate and it requires relatively little space.

While a preferred embodiment of the invention has been described in detail, it should be apparent that many modifications and variations thereto are possible, all of which fall within the true spirit and scope of the invention.

I claim:

1. A radio frequency (RF) lens for receiving and focusing a plurality of RF signals, comprising:

a transmission cavity means, including a plurality of probe sites therein, the cavity being of predetermined construction to transmit RF signals among said probe sites;

a plurality of probe pairs, each pair predeterminedly positioned at each probe site;

coupler means for coupling each one of said plurality of RF signals to one of said probe pairs, the coupler means coherently combining RF signals received by each probe of a probe pair to provide a first summed output and incoherently combining the RF signals received by each probe of the respective probe pair to provide a second difference output.

2. The radio frequency lens of claim 1 wherein:

the transmission cavity means is comprised of a pair of parallel circular plates, the plates being spaced by less then one half the wavelength of said radio frequency; and wherein each probe site is centered on a radius of said cavity.

3. The radio frequency lens of claim 1 wherein the coupler means comprises a plurality of 180° couplers, each coupler coupling one of said plurality of RF signals to one of said probe pairs.

4. The radio frequency lens of claim 1 further comprising power dissipation means coupled to said coupler means second difference output for dissipating incoherent RF signals therefrom.

5. The radio frequency lens of claim 2 wherein the coupler means comprises a plurality of 180° couplers, each coupler coupling one of said plurality of RF signals to one of said probe pairs.

6. The radio frequency lens of claim 3 wherein each 180° coupler is comprised of conductive strips located on both sides of a dielectric board, the strip on one side formed in a "C" pattern with each arm of the "C" having a length of approximately one quarter wavelength of the radio frequency and with the body portion of the "C" having a length of approximately one half wavelength of the radio frequency, and wherein the conductive strip on the other side of the board is formed having a length approximately one half wavelength of the radio frequency and being in register with the body portion of the "C" strip, said conductive strip on the other side of the board being broken at its center portion with the two divided portions being bridged by a predetermined value load resistor, and the corresponding RF signal is applied to the central area of the body portion of said "C" shaped strip.

7. The radio frequency lens of claim 5 wherein each 180° coupler is comprised of conductive strips located on both sides of a dielectric board, the strip on one side formed in a "C" pattern with each arm of the "C" having a length of approximately one quarter wavelength of the radio frequency and with the body portion of the "C" having a length of approximately one half wavelength of the radio frequency, and wherein the conductive strip on the other side of the board is formed having a length approximately one half wavelength of the radio frequency and being in register with the body portion of the "C" strip, said conductive strip on the other side of the board being broken at its center portion with the two divided portions being bridged by a predetermined value load resistor, and the corresponding RF signal is applied to the central area of the body portion of said "C" shaped strip.

8. The radio frequency lens of claim 7 wherein each 180° coupler is positioned within the cavity at a probe site such that each coupler serves as a probe pair.

9. The radio frequency coupler of claim 3 wherein each 180° coupler is comprised of a wire loop formed in a substantially rectangular configuration with first and second opposing sides having a length approximately equal to one half wavelength of the radio frequency annd third and fourth opposing sides having a length approximately equal to one quarter wavelength of the radio frequency, said second side being broken at its central portion with the two divided portions being bridged by a predetermined value load resistor, and the corresponding RF signal is applied to the central portion of said first side.

10. The radio frequency coupler of claim 5 wherein each 180° coupler is comprised of a wire loop formed in a substantially rectangular configuration with first and second opposing sides having a length approximately equal to one half wavelength of the radio frequency and third and fourth opposing sides having a length approximately equal to one quarter wavelength of the radio frequency, said second side being broken at its central portion with the two divided portions being bridged by a predetermined value load resistor, and the corresponding RF signal is applied to the central portion of the said first side.

11. The radio frequency coupler of claim 10 wherein each 180° coupler is positioned within the cavity at a probe site such that each coupler serves as a probe pair.

12. The radio frequency coupler of claim 2 wherein each probe site is located approximately one quarter wavelength from the perimeter of the transmission cavity.

13. The radio frequency coupler of claim 6 wherein each 180° coupler is positioned within the cavity at a probe site such that each coupler serves as a probe pair.

14. The radio frequency coupler of claim 9 wherein each 180° coupler is positioned within the cavity at a probe site such that each coupler serves as a probe pair.

15. The radio frequency lens of claim 3 wherein each 180° coupler is comprised of conductive strips located on both sides of a dielectric board, the strip on one side formed in a "C" pattern with each arm of the "C" having a length of approximately one quarter wavelength of the radio frequency and with the body portion of the "C" having a length of approximately one half wavelength of the radio frequency, and wherein the conductive strip on the other side of the board is formed having a length approximately one half wavelength of the radio frequency and being in register with the body portion of the "C" strip, the body portion of the "C" strip being broken at its center portion with the two divided portions being bridged by a predetermined value load resistor, and the corresponding RF signal is applied to the central area of the conductive strip on the other side of the board.

16. A radio frequency (RF) lens for receiving and focusing a plurality of RF signals, comprising:

a transmission cavity means, including a plurality of probe sites therein, the cavity being of predetermined construction to transmit RF signals among said probe sites;

a plurality of probe pairs, each pair predeterminedly positioned at each probe site;

four-port coupler means for coupling each one of said plurality of signals to one of said probe pairs, the four-port coupler means including first and second input ports coupled to first and second probes of a probe pair and first and second output ports, the four-port coupler means coherently combining received RF signals from the first and second input ports to provide a summed output signal at the first output port and incoherently combining the received RF signals from the first and second input ports to provide a difference output signal at the second output port.

17. The radio frequency lens of claim 16 wherein the transmission cavity means is comprised of a pair of parallel circular plates, the plates being spaced by less than one half the wavelength of said radio frequency; and wherein each probe site is centered on a radius of said cavity.

18. The radio frequency lens of claim 16 wherein the coupler means comprises a plurality of 180° couplers, each coupler coupling one of said plurality of signals to one of said probe pairs.

19. The radio frequency lens of claim 16 further comprising power dissipation means coupled to the second output port for dissipating the difference output signal therefrom.

20. A radio frequency (RF) lens for receiving and focusing a plurality of RF signals, comprising:

a transmission cavity means, including a plurality of probe sites therein, the cavity being of predetermined construction to transmit RF signals among said probe sites;

a plurality of probe pair means, each probe pair means predeterminedly positioned at each probe site and coupled to a corresponding one of said plurality of RF signals, each probe pair means further including means for coherently combining RF signals received by the probe pair means to provide a first summed output and incoherently combining the RF signals received by the probe pair means to provide a second difference output.

21. The radio frequency coupler of claim 20 wherein each probe pair means are comprised of a wire loop formed in a substantially rectangular configuration with first and second opposing sides having a length approximately equal to one half wavelength of the radio frequency and third and fourth opposing sides having a length approximately equal to one quarter wavelength of the radio frequency, said second side being broken at its central portion with the two divided portions being bridged by a predetermined value load resistor, and the corresponding RF signal is applied to the central portion of the said first side.

22. The radio frequency lens of claim 20 wherein each probe pair means are comprised of conductive strips located on both sides of a dielectric board, the strip on one side formed in a "C" pattern with each arm of the "C" having a length of approximately one quarter wavelength of the radio frequency and with the body portion of the "C" having a length of approximately one half wavelength of the radio frequency, and wherein the conductive strip on the other side of the board is formed having a length approximately one half wavelength of the radio frequency and being in register with the body portion of the "C" strip, said conductive strip on the other side of the board being broken at its center portion with the two divided portions being bridged by a predetermined value load resistor, and wherein the coupler means applies said RF signal to the central area of the body portion of the "C" shaped strip.

23. The radio frequency lens of claim 20 wherein each probe pair means are comprised of conductive strips located on both sides of a dielectric board, the strip on one side formed in a "C" pattern with each arm of the "C" having a length of approximately one quarter wavelength of the radio frequency and with the body portion of the "C" having a length of approximately one half wavelength of the radio frequency, and wherein the conductive strip on the other side of the board is formed having a length approximately one half wavelength of the radio frequency and being in register with the body portion of the "C" strip, the body portion of strip being "C" strip broken at its center portion with the two divided portions being bridged by a predetermined value load registor, and the corresponding RF signal is applied to the central area of the conductive strip on the other side of the board.

* * * * *